US010773279B2

(12) United States Patent
McDonald

(10) Patent No.: US 10,773,279 B2
(45) Date of Patent: Sep. 15, 2020

(54) MOP CLEANING SYSTEM AND METHOD FOR CLEANING A MOP

(71) Applicant: Tim McDonald, Missouri City, TX (US)

(72) Inventor: Tim McDonald, Missouri City, TX (US)

( * ) Notice: Subject to any disclaimer, the term of this patent is extended or adjusted under 35 U.S.C. 154(b) by 0 days.

(21) Appl. No.: 16/381,569

(22) Filed: Apr. 11, 2019

(65) Prior Publication Data

US 2019/0283089 A1 Sep. 19, 2019

Related U.S. Application Data

(63) Continuation-in-part of application No. 16/039,948, filed on Jul. 19, 2018, which is a continuation-in-part of application No. 15/993,913, filed on May 31, 2018, which is a continuation-in-part of application No. 14/877,519, filed on Oct. 7, 2015, now Pat. No. 10,456,812, which is a continuation-in-part of application No. 14/812,545, filed on Jul. 29, 2015, now Pat. No. 9,408,412, which is a continuation-in-part of application No. 14/550,195, filed on Nov. 21, 2014, now Pat. No. 9,320,286.

(60) Provisional application No. 62/640,261, filed on Mar. 8, 2018.

(51) Int. Cl.
*B08B 3/04* (2006.01)
*E03C 1/24* (2006.01)

(52) U.S. Cl.
CPC ..... *B08B 3/048* (2013.01); *E03C 1/24* (2013.01)

(58) Field of Classification Search
CPC ..... B08B 3/048
See application file for complete search history.

(56) References Cited

U.S. PATENT DOCUMENTS

| | | | |
|---|---|---|---|
| 4,815,160 | A | 3/1989 | Smith |
| 5,288,022 | A | 2/1994 | Sesser |
| 6,374,867 | B1 | 4/2002 | Maiuro |
| 6,976,286 | B1 | 12/2005 | Sanabria |
| 2004/0019998 | A1 | 2/2004 | Sander |
| 2005/0076465 | A1 | 4/2005 | Rousey |
| 2009/0265871 | A1 | 10/2009 | Wooten |
| 2014/0263105 | A1 | 9/2014 | Kontorovich et al. |

(Continued)

FOREIGN PATENT DOCUMENTS

| | | | |
|---|---|---|---|
| CN | 107684406 | A | 2/2018 |
| TW | 201117762 | A | 6/2011 |
| WO | 2017/143135 | A1 | 8/2017 |

OTHER PUBLICATIONS

International Search Report and Written Opinion of the ISA for corresponding PCT/US2019/037178.

*Primary Examiner* — Jason Y Ko
(74) *Attorney, Agent, or Firm* — Egbert, McDaniel & Swartz, PLLC

(57) ABSTRACT

A mop cleaning system has a mop basin having a floor and a drain, a chamber affixed to the mop basin in a location away from the drain, a water inlet opening within the interior volume of the chamber, and a water source connected to the water inlet. The water inlet is adapted to pass water in an area adjacent to a bottom of the chamber. The water source is adapted to pass water under pressure into the water inlet. The chamber is fixedly mounted to the floor of the mop basin. The chamber has an outlet located at above the water inlet.

17 Claims, 7 Drawing Sheets

(56) References Cited

U.S. PATENT DOCUMENTS

| | | | | |
|---|---|---|---|---|
| 2016/0143345 | A1* | 5/2016 | McDonald | B08B 3/102 134/10 |
| 2018/0146689 | A1 | 5/2018 | McDonald | |

* cited by examiner

MOP CLEANING SYSTEM AND METHOD FOR CLEANING A MOP

CROSS-REFERENCE TO RELATED APPLICATIONS

The present application is a continuation-in-part of U.S. patent application Ser. No. 16/039,948 filed on Jul. 19, 2018, and entitled "Washing Bucket for Household, Commercial and Industrial Use for Cleaning Mops", presently pending. U.S. patent application Ser. No. 16/039,948 claims priority to U.S. Provisional Application No. 62/640,261, filed Mar. 8, 2018. U.S. patent application Ser. No. 16/039,948 is a continuation-in-part of U.S. patent application Ser. No. 15/993,913, filed on May 31, 2018, and entitled "Washing Bucket for Household, Commercial and Industrial Use for Cleaning Mops and for Chemical Cleaning", presently pending. U.S. application Ser. No. 15/993,913 is a continuation-in-part of U.S. application Ser. No. 14/877,519, filed on Oct. 7, 2015, and entitled "Apparatus and Method for Washing Meat and/or Produce", presently pending. U.S. patent application Ser. No. 14/877,519 is a continuation-in-part of U.S. patent application Ser. No. 14/812,545, filed on Jul. 29, 2015, and entitled "Apparatus and Method for Cleaning Produce". U.S. patent application Ser. No. 14/812,545 issued as U.S. Pat. No. 9,408,412 on Aug. 9, 2016. U.S. patent application Ser. No. 14/812,545 is a continuation-in-part of U.S. patent application Ser. No. 14/550,159, filed on Nov. 21, 2014. U.S. patent application Ser. No. 14/550,195 issued as U.S. Pat. No. 9,320,286 on Apr. 26, 2016, and is entitled "Apparatus and Method for Cleaning Game".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

Field of the Invention

The present invention relates to mop basins. More particularly, the present invention relates to the cleaning of mops in such mop basins. Additionally, the present invention relates to mop basins having a chamber that can receive a continuous supply of fresh water during the washing and rinsing of the mop. The present invention also relates to mop cleaning methods in commercial and industrial settings.

Description of Related Art Including Information Disclosed Under 37 CFR 1.97 and 37 CFR 1.98

Mop basins are commonly used in industrial and commercial settings for the cleaning of mops. Typically, during the cleaning activities carried out in such industrial and commercial settings, a mop bucket is used. The mop bucket is filled with water. The mop strings of a mop are introduced into the water in the mop bucket and then applied to a floor or other location so as to clean the floor. At the start of the cleaning process, the fluid used for mopping is held within the mop bucket and is generally clean. However, as the floor is mopped and the mop is repeatedly dipped into the bucket, the fluid in the mop bucket becomes less and less clean as dirt, debris and other matter is transferred from the floor to the wet mop and then into the fluid in the bucket. Occasionally, a user may place the mop into a ringer located above the bucket in order to remove fluid from the mop, but again, this merely transfers dirty fluid to the fluid within the mop bucket.

After the mopping activities are completed, the mop bucket and the mop are generally transferred to a janitorial closet or the like. The janitorial closet usually has a sink therein. The sink can be in an elevated position. The person carrying out the mopping activities must then lift the mop bucket so as to release the fluid in the mop bucket, along with the dirt and debris, into the sink. The dirt and debris on the mop generally will remain unclean unless the worker takes extra steps so as to fill the sink with clean water and then introduce the dirty mop strings into the clean water in the sink. The worker must then agitate the mop strings within the clean water in order to release debris. Even under these circumstances, the clean water within the sink will become filled with dirt and debris and the mop will not be completely cleaned. Under most circumstances, the worker will simply dump the water from the mop bucket into the sink and will not carry out any other cleaning activities. As such, the strings of the mop become dirtier and dirtier over time.

In certain janitorial closets, mop basins are employed. FIGS. 1 and 2 illustrate these types of mop basins. As seen in FIG. 1, the mop basin 10 is positioned on a floor 12 of the janitorial closet. The mop basin 10 includes a drain 14 located centrally thereof. Walls 16 of the mop basin 10 create an interior volume. There is a top edge of the mop basin which includes an indentation 18. Indentation 18 facilitates the ability to dump the contents of the mop bucket into the interior volume of the mop basin 10. A water source 20 is located above the mop basin 10. The water source 20 is typically in the nature of a faucet. A hose 22 is connected to a faucet 20 so as to allow water to be introduced into the mop basin 10 or to be directed toward the strings 24 of a mop.

In normal use, the mop basin 10 allows the worker to dump the contents of the mop bucket into the interior volume of the mop basin 10. These contents will flow outwardly of the mop basin 10 through the drain 14. The worker can then place the mop strings 24 into the mop basin 10. The water source 20 can then be activated so as to deliver water through the hose 22. The worker will grab one end of the hose 22 and direct water to the mop strings 24 so as to clean the debris off of the mop strings 24. The mop can then be hung in a desired location above the mop basin 10 so that drainage from the mop strings 24 will be directed into the interior volume of the mop basin 10.

In FIG. 1, the mop basin 10 is simply placed onto the floor 12 and secured by fasteners to a wall extending upwardly from the floor 22. FIG. 2 shows another type of mop basin 30 which is actually a fixture built into the janitorial closet. In FIG. 2, the mop basin 30 has walls 32 and 34 extending upwardly on opposite sides of the mop basin 30. There is a frontal wall 36 of a height less than the walls 32 and 34. A water source 38 is connected to a hose 40 which, in turn, is directed toward a spray-type nozzle 42. Once again, in the mop basin 30, as shown in FIG. 2, the contents of the mop bucket are delivered into the interior volume of the mop basin 30. The water source 38 can be activated so as to deliver water through hose 40 and outwardly of spray attachment 42. The worker can then use the spray attachment 42 to direct water to the mop strings for the purposes of cleaning the mop strings.

In either of the embodiments of FIGS. 1 and 2, the cleaning of the mop strings after the mop bucket is dumped is somewhat difficult for the worker. Under many circumstances, the worker will avoid this inconvenient activity. As a result, the strings of the mop will remain dirty. Over time, the dirt, grease and debris will accumulate on the mop strings. During the cleaning activities, the dirt from the mop strings can continue to be applied to those surfaces that are intended to be cleaned by the mop. As such, a need has developed so as to provide a mop basin which allows workers to easily and conveniently clean the strings of the mop and to assure that the water used for cleaning the mop strings continues to be clean.

A problem often encountered with the use of mop basin is that the dirt deposited into the water in the mop basin tends to collect at the bottom of the mop basin. As such, the dirty water can then be absorbed back into the mop. The mop then spreads the dirt back out onto the floor leaving unsightly streaks in leading to incomplete cleaning. In order to alleviate this problem, the mop basin has to be repeatedly cleaned.

The problem is twofold. First, there is the difficulty of separating the heavy components, such as dirt or grease attached to the dirt, from the cleaner water in the mop basin. The second difficulty is turbulence within the water caused by the swishing of the mop within the mop basin. The turbulence tends to disturb the sludge and components of dirty water and distribute them within the water in the mop basin in order to be picked up again when the mop is rinsed in the mop basin.

Another problem with existing mop basins is that it is difficult to maintain a supply of hot water within the mop basins. Hot water is important for removing grease or other contaminants from the strings of a mop. Cold water is generally less effective at removing such contaminants. With existing mop basins, even if a supply of hot water is initially introduced into the mop basin, the instant the strings of the mop are placed into the hot water, the temperature of the water greatly diminishes. Over time, the heat exchange between the relatively cold strings of the mop and the water within the mop basin will reduce the temperature of the water to the ambient temperature. As such, a need has developed so as to continuously supply hot water to the mop basin throughout the cleaning process.

In the past, various patents have issued with respect to mop cleaning devices. For example, U.S. Pat. No. 3,630,369 teaches a mop cleaning device wherein a supply of cleaning fluid is circulated through a container. However, relatively heavy particles are separated from the fluid by what appears to be a gravity trap while leaving smaller particles still suspended within the fluid. In another example, U.S. Pat. No. 4,161,799 discloses a mop bucket that treats dirty fluid. However the system leaves undesirable matter within the bucket itself.

In the past, various patents have issued relating to mop buckets and cleaning systems for mop buckets. For example, U.S. Pat. No. 5,333,353, issued on Aug. 2, 1994 to M. Taylor, teaches a mop wringer that has a long operating handle and mounts on the rear wall of the bucket. When so mounted, the wringer is supported on the sidewalls of the bucket at or toward the front of the wringer by support ledges integrally molded into the sidewalls of the bucket below the lower rim thereof. The ringer engages the bucket in the manner which opposes the tendency for the back of the wringer to lift off of the bucket when operating force is applied to the wringer handle.

U.S. Patent Application Publication No. 2005/0076465, published on Apr. 14, 2005 to B. Rousey, describes a mop bucket filtering system. This mop bucket filtering system includes a mop bucket defining a cleaning solution basin. A pump is externally mounted on the bucket and is in fluid communication with the cleaning solution basin. A filter system is exteriorly mounted on the bucket in fluid communication with the cleaning solution basin and is operationally connected to the pump. The pump draws fluid from the cleaning solution basin through the filter system for return to the basin after the cleaning solution has been filtered.

U.S. Pat. No. 6,000,094, issued on Dec. 14, 1999 to R. S. Young, teaches a removal and replaceable filter and filter holder for a mop cleaning bucket. This filter receives dirt settling under gravity from the contained liquid so that the dirt collects in and passes through the filter so as to be trapped therebelow. The holder is a rigid or substantially rigid perforated support structure spaced above and below the dirt-receiving filter. The holder is supported in the bucket in spaced relation to the bottom of the bucket and protects the filter. The filter is a thin, sturdy, semi-rigid and floatable member with many holes so that soiled water passes through and collects in the bottom of the bucket.

U.S. Pat. No. 5,976,266, issued on Nov. 2, 1999 to Anderson et al., provides a method for cleaning and wringing a mop. The mop is provided with a handle, mop strings and a plunger. The plunger is located between the handle and the mop strings. A sleeve having a top and an open bottom end is provided with the sleeve being perforated near the bottom end. The sleeve is tapered so that the bottom end is larger than the top end. The plunger and the mop strings are located inside the sleeve with the plunger positioned near the top end of the sleeve and the mop strings depending from the plunger. The bottom end of the sleeve is located in a liquid so that the liquid enters a bottom portion of the sleeve through the perforations. The handle is moved down so as to compress the mop strings with the plunger, with the mop strings being immersed in the liquid, so as to force dirt from the mop strings out of the sleeve perforations. The handle is moved up so as to raise the plunger inside the sleeve and decompress the mop strings so as to allow the mop strings to absorb liquid from outside the sleeve to the perforations.

It is object of the present invention to provide a mop cleaning system that effectively cleans the mop strings of a mop.

It is another object of the present invention to provide a mop cleaning system allows a continuous supply of clean water to be delivered to the mop when the mop strings are positioned within the mop basin.

It is another object of the present invention to provide a mop cleaning system whereby a continuous supply of clean hot water is maintained within the interior of the mop cleaning system.

It is still another object of the present invention to provide a mop cleaning system that effectively discharges debris from the mop basin.

It is another object of the present invention to provide a mop cleaning system that is adapted for commercial and industrial uses.

It is still another object of the present invention to provide a mop cleaning system that enhances the ability to effectively clean and mop a floor.

It is another object of the present invention provide a mop cleaning system that is easy to use, relatively inexpensive and easy impact that to manufacture.

It is still further object of the present invention provide a mop cleaning system that allows debris and dirty water to be directed to a specific location exterior of the mop cleaning system.

It is still another object the present invention to provide a mop cleaning system that encourages a worker to clean the mop strings after the mop bucket is dumped into the mop basin.

These and other objects and advantages of the present invention will become apparent from a reading of the attached specification and appended claims.

BRIEF SUMMARY OF THE INVENTION

The present invention is a mop cleaning system that comprises a mop basin having a floor and a drain, a chamber affixed to the mop basin in a location away from the drain, a water inlet opening within the interior volume of the chamber, and a water source connected to the water inlet adapted to pass water under pressure into the water inlet. The chamber has an open top and an interior volume. The water inlet is adapted to pass water in an area adjacent to a bottom of the chamber.

The chamber can be fixedly mounted to the floor of the mop basin. The chamber can have a rectangular, square or circular configuration.

In one embodiment the present invention, the water inlet extends through a wall of the chamber so as to have one end within the interior volume. The water inlet has a connector at an opposite end. The connector is connected to the water source. The end of the water inlet is a nozzle. This nozzle is adapted to direct water across the bottom of the chamber. In a particular embodiment of the present invention, the nozzle has an aperture having a shape of a chord of a circle. A straight edge of the chord of the circle is below a curved portion of the chord of the circle.

In an alternative embodiment of the present invention, the water inlet comprises a pipe extending vertically within the chamber. The pipe has a plurality of apertures formed through a wall thereof. In a particular form of the present invention, the plurality of apertures comprise a first set of apertures extending in one direction and a second set of apertures extending in another direction. One of the first and second sets of apertures is directed further away from wall of the chamber than the other of the first and second sets of apertures. A plurality of spacers can be affixed to the pipe and extend outwardly therefrom. The plurality of spacers bear against the wall of the chamber. The plurality of spacers are in spaced relation to each other.

In another embodiment of the present invention, the pipe has a first portion and a second portion. The first portion extends vertically within the chamber. The second portion radiates outwardly from the first portion. At least one of the first and second portions has the plurality of apertures therein. The second portion of the pipe is positioned adjacent to a bottom of the chamber. The second portion of the pipe extends from the bottom of the first portion. In one form of the present invention, the second portion of the pipe has the plurality of apertures. This plurality of apertures of the second portion open so as to direct water upwardly in the chamber.

In still another embodiment of the present invention, the second portion of the pipe comprises a plurality of pipe sections radiating outwardly from the bottom of the first portion of the pipe. The plurality of pipe sections are radially spaced from each other.

The chamber has an outlet. In one embodiment, the outlet is the open top of the chamber. In another embodiment, the outlet is an opening through the wall of the chamber. This outlet is positioned above the water inlet and generally adjacent to the top of the chamber. In another embodiment, the outlet is a conduit extending from the chamber and directed toward the drain such that water from the chamber is directed toward the drain.

In the present invention, the water source is a faucet that is positioned above the mop basin. The faucet has a hose extending so as to connect to the water inlet.

The present invention is also a method of cleaning a mop. This method includes the steps of: (1) positioning a chamber in the mop basin away from a drain of the mop basin; (2) flowing water into the chamber; (3) lowering strings of the mop into the flowing water in the chamber such that the flowing water releases debris from the strings of the mop; (4) continuing the flow of water until the debris in the water either overflows a top of the chamber or flows outwardly through an outlet of the chamber; and (5) passing the debris and the water outwardly of the mop basin through the drain. In the method of the present invention, a water source is connected to a water inlet of the chamber. The water inlet directs the water from the water source adjacent to the bottom of the chamber.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 3:
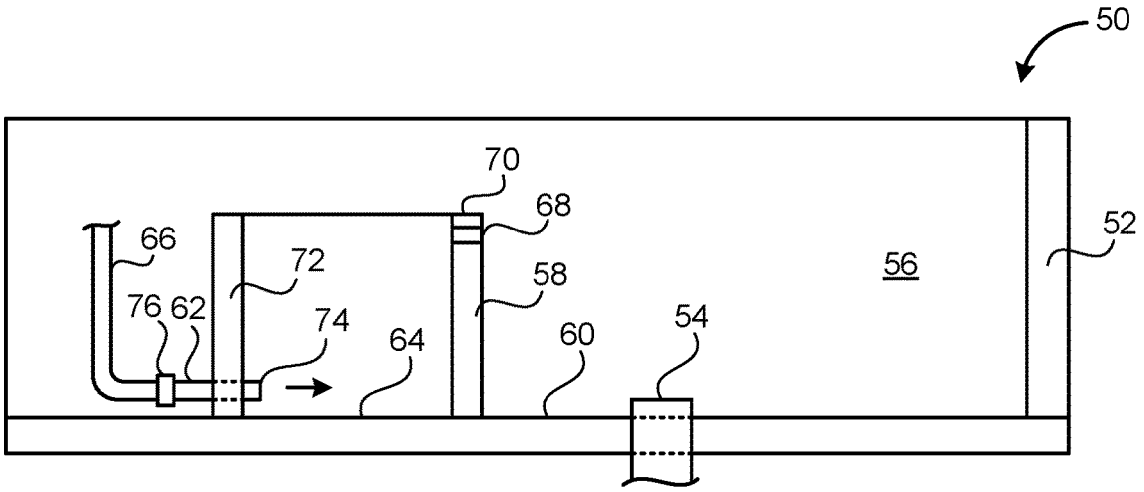
FIG. 3 is a side cross-sectional view showing one embodiment of the mop cleaning system of the present invention.

Referring to FIG. 3, there is shown a first embodiment of the mop cleaning system 50 of the present invention. The mop cleaning system 50 includes a mop basin 52 having a drain 54 and an interior volume 56. A chamber 58 is affixed to the floor 16 of the mop basin 52 and extends upwardly therefrom. A water inlet 62 is positioned adjacent to a bottom 64 of the chamber 58 so as to direct a flow of water adjacent to the bottom 64 of the chamber 58. The arrow in FIG. 3 illustrates this flow of water from the water inlet 62. A water source 66 is connected to the water inlet 62 so as to deliver water under pressure into the water inlet 62.

In FIG. 3, it can be seen that the chamber 58 is positioned away from the drain 54 within the interior volume 56 of the mop basin 52. The chamber 58 has an outlet 68 located adjacent to the top 70 of the chamber 58 and above the location of the water inlet 62. The water inlet 62 extends through a wall 72 of the chamber 58. One end 74 of the water inlet 62 releases water in a strong sweeping manner across the bottom of the chamber 58. The opposite end 76 of the water inlet 62 has a connector thereon. The connector connects to the water source 66.

Figure 4:
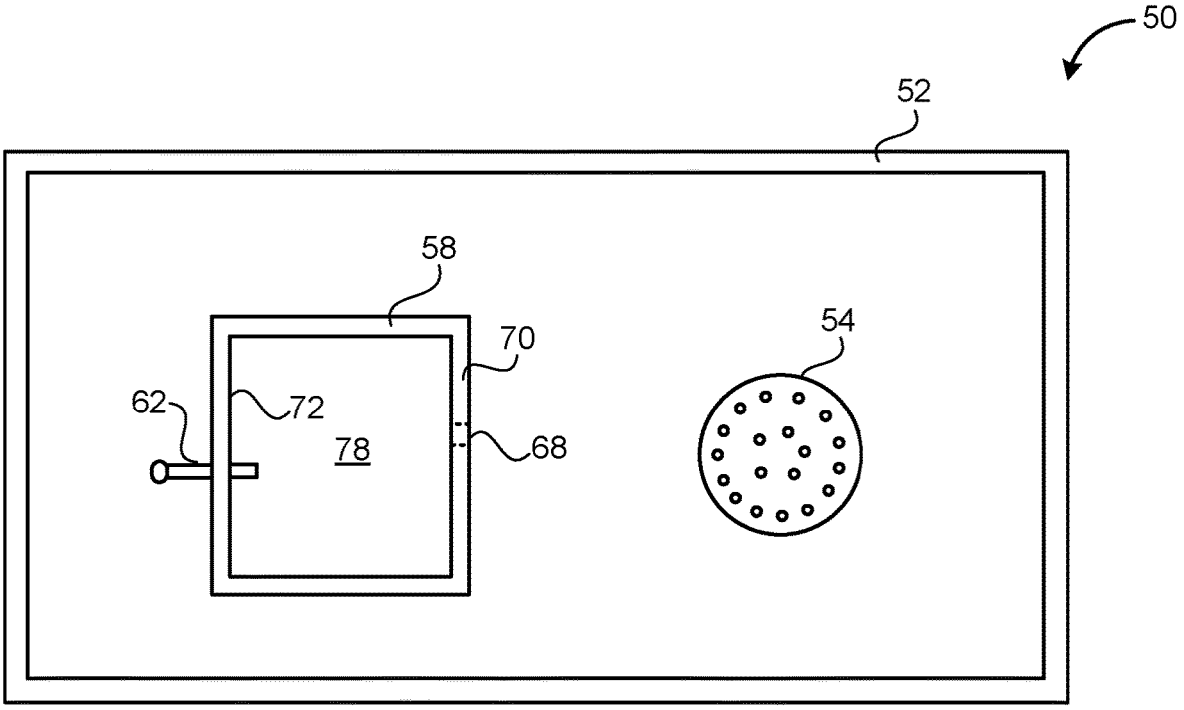
FIG. 4 is a plan view of the embodiment of the mop cleaning system of FIG. 3.

FIG. 4 is a plan view of the mop cleaning system 50 as shown in FIG. 3. It can be seen that the mop basin 52 has a generally rectangular configuration. Similarly, the chamber 58 also has a square or rectangular configuration. The chamber 58 is located away from the drain 54. Chamber 58 has an interior volume 78. The top 70 of the chamber 58 defines the open top of the chamber 58. In normal use, the strings of a mop can be introduced through this open top and into the interior volume 78 of the chamber 58. The water inlet 62 is illustrated as extending through the wall 72 of the chambers 58. Outlet 68 (shown in broken lines) is formed through a wall opposite to the wall 72.

Figure 5:
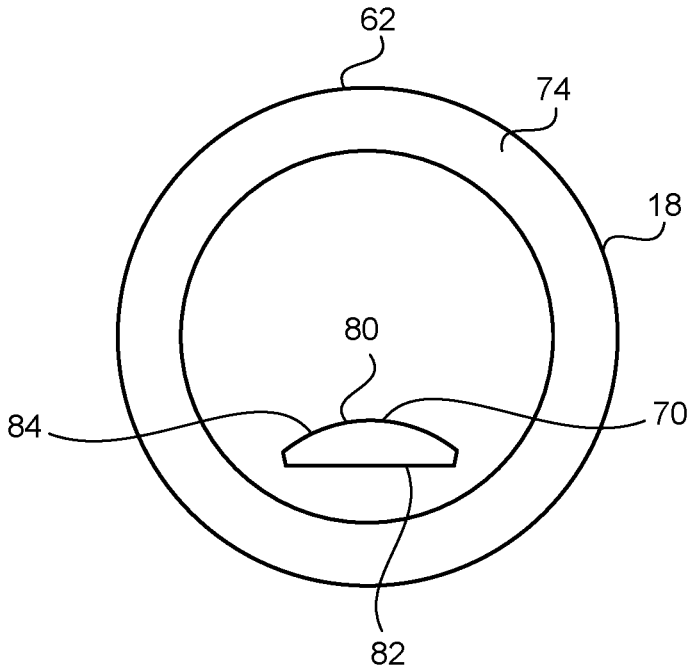
FIG. 5 is an end view showing the configuration of the nozzle as used in the mop cleaning system of FIGS. 3 and 4.

FIG. 5 illustrates the end 74 of the water inlet 62. In particular, it can be seen that the end 74 is a nozzle is adapted to direct a pressurized flow of water adjacent to an area adjacent to the bottom of the chamber 58. The nozzle 80 has the shape of a chord of a circle. The straight edge 82 of the chord of the circle is below the curved portion 84. Experiments with this configuration of nozzle 80 has shown that it creates a strong laminar flow of water in a straight direction adjacent to the bottom 64 of the chamber 58. As such, this flow of water interacts with the strings of a mop so as to forcibly remove debris and grease from the mop strings.

Figure 6:
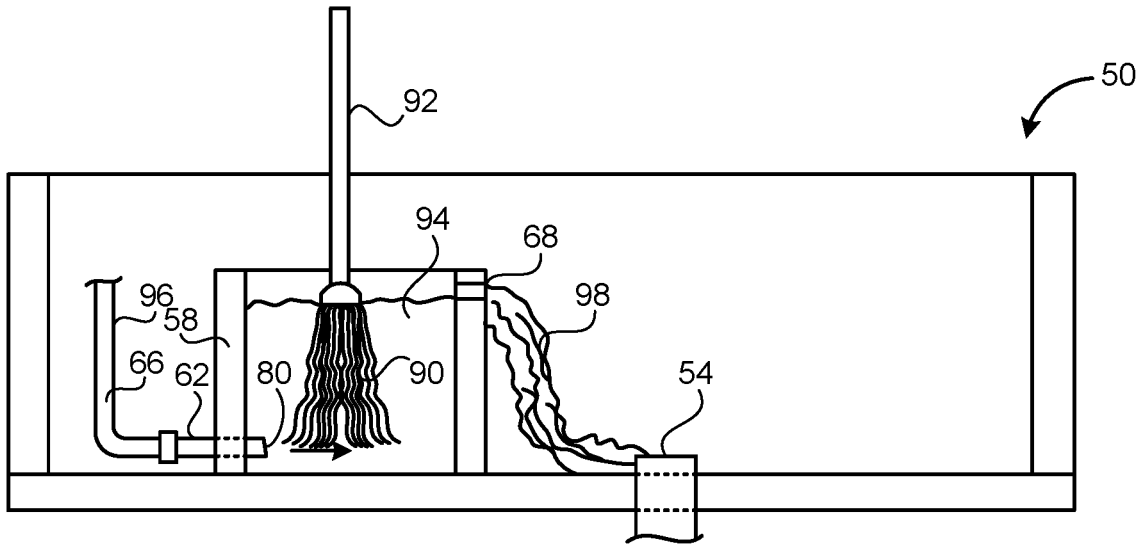
FIG. 6 is a side cross-sectional view showing the method of the present invention for cleaning the strings of a mop.

FIG. 6 illustrates the method of cleaning the strings 90 of a mop 92 using the mop cleaning system 50 of the previous embodiments. In FIG. 6, can be seen that the chamber 58 has water 94 therein. Water 94 has been provided by the water source 66 and through the water inlet 62. Once the faucet associated with the water source 66 is activated or turned on, water is passed under pressure through the hose 96, through the water inlet 62 and outwardly of the nozzle 80. Water will eventually accumulate within the chamber 58. The strong flow of water emitted from the nozzle 80 will create a strong turbulent action of the water 94 so as to release dirt, grease and debris from the strings 90 of the mop 92. Since the dirt, grease and debris from the strings 90 of mop 92 are lighter than water, they will tend to flow upwardly. As water continues to flow into the interior volume of the chamber 58, the water will eventually be released through the outlet 68. As such, the debris and water 98 will flow outwardly of the chamber 58 and downwardly toward the drain 54. The water source will continue to deliver clean and hot water outwardly through the nozzle 80. This continually dilutes the water within the interior of the chamber 58 so that clean water is always present within the chamber 58 for interaction with the mop strings.

Figure 1:
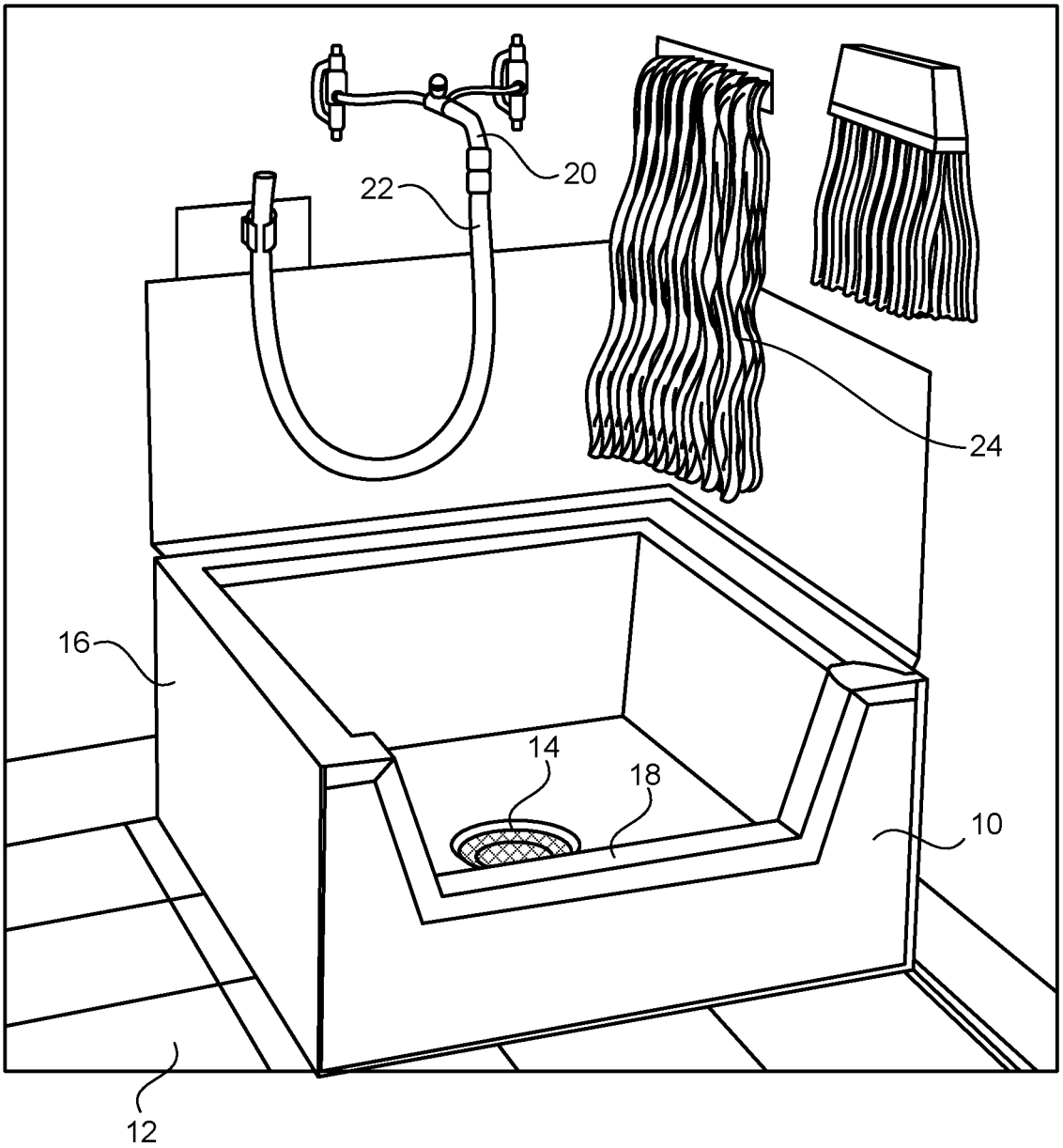
FIG. 1 PRIOR ART
FIG. 1 is a perspective view of one type of mop basin of the prior art.
Figure 2:
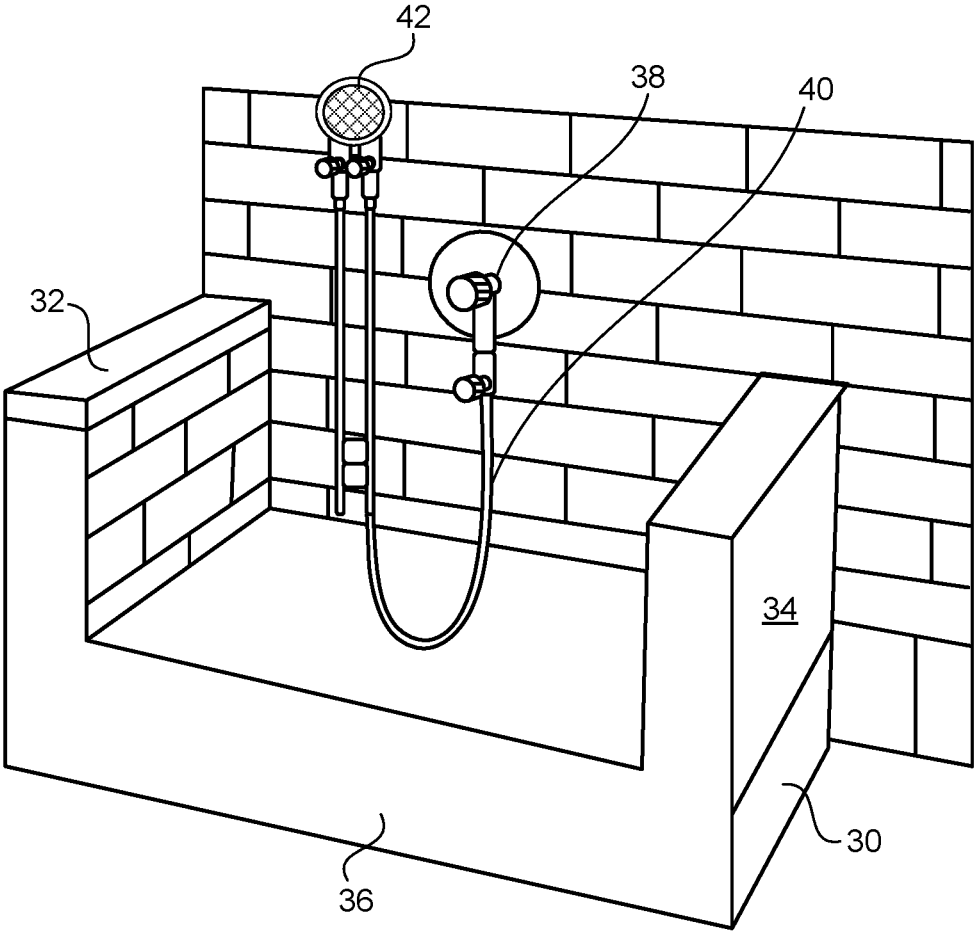
FIG. 2 PRIOR ART
FIG. 2 is a perspective view of another type of mop basin of the prior art.

Unlike the prior art, the mop cleaning system 50 is extremely easy to use. The user simply takes the mop and lowers the strings of the mop into the interior of the chamber 58. The water action will do the rest of the work. If the worker desires, the worker can swish the mop strings 90 within the water 94 during this cleaning process so as to further agitate the water in release dirt and debris from the mop strings. However, the turbulent action of the water within the chamber 58 will do most of the work of separating dirt, debris and grease from the mop strings 90. As such, the mop strings 90 will continue to be clean and available for future use in mopping the floor. After the mop strings 90 have been cleaned after a period of time, the faucet associated with the water source 96 can be turned off. The water source 96 can have the configuration of either of the water sources shown in the prior art of FIGS. 1 and 2.

Figure 7:
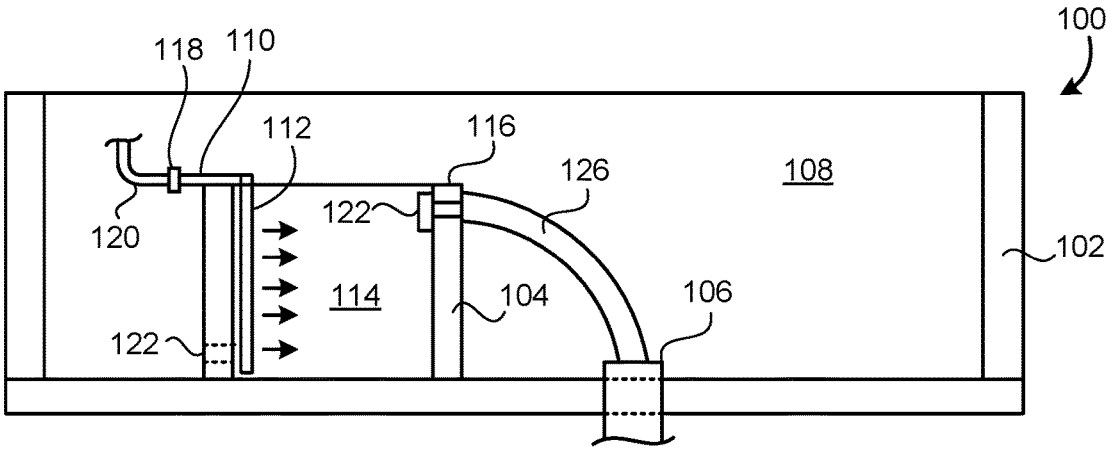
FIG. 7 is a side cross-sectional view showing another alternative embodiment of the mop cleaning system of the present invention.

FIG. 7 shows an alternative embodiment of the mop cleaning system 100 of the present invention. Mop cleaning system 100 includes a mop basin 102 and a chamber 104 positioned away from the drain 106 in the interior volume 108 of the mop basin 102. The fluid inlet 110 comprises a pipe 112 that extends vertically downwardly in the interior volume 114 of the chamber 104. The arrows in FIG. 7 illustrates the flow of water outwardly of the pipe 102. The water inlet 110 is shown as extending over the top 116 of the chamber 104. The water inlet 110 has a connector 118 that is configured to be joined to a hose 120 associated with the water source. The broken lines 122 as shown in FIG. 7 illustrates that the water inlet 110 can enter the pipe 112 from a bottom of the chamber 104 (as an alternative embodiment)

In FIG. 7, it can be seen that the outlet 124 is located adjacent to the top 116. Outlet 122 extends through the wall of the chamber 104. A conduit 126 is connected to the outlet 122. Conduit 126 extends outwardly of the chamber 104 and is generally directed toward the drain 106. As such, as with the previous embodiment, the accumulation of dirt, debris and grease will eventually flow outwardly from the interior volume 114 of the chamber 104 and outwardly through the outlet 122 and toward the drain 106 by way of conduit 126.

Figure 8:
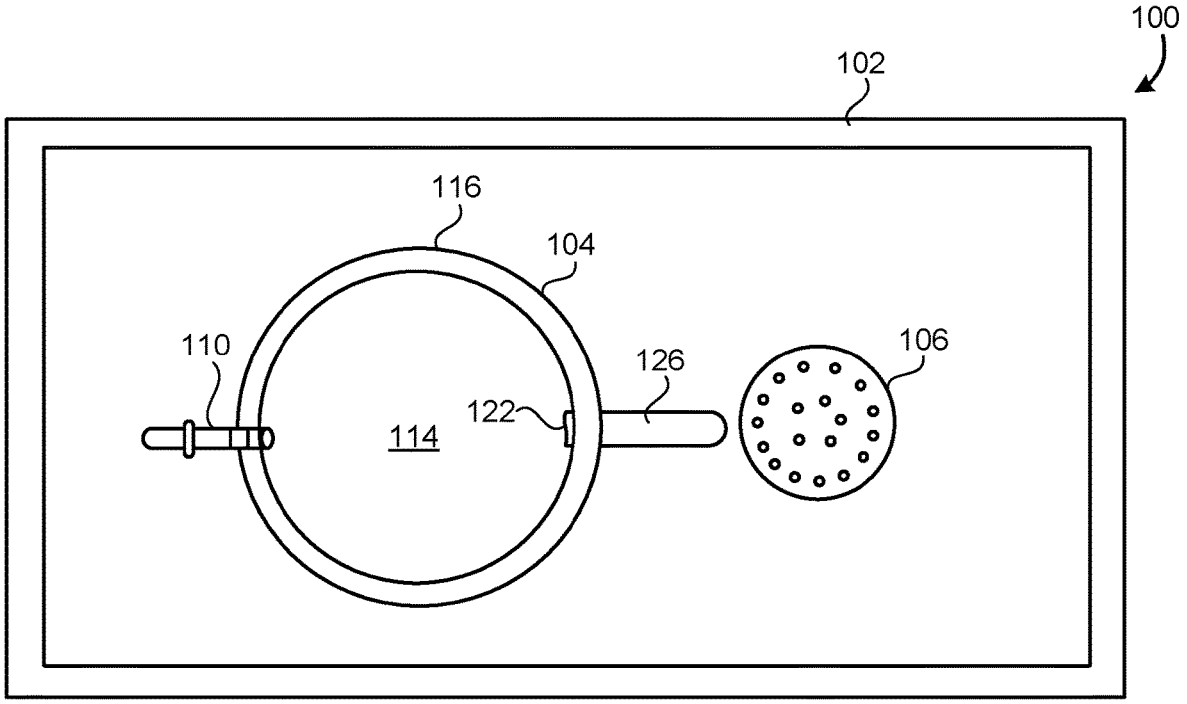
FIG. 8 is a plan view showing the mop cleaning system of the embodiment of FIG. 7.

FIG. 8 is a plan view showing the mop cleaning system 100 of FIG. 7. In particular, the mop basin 102 has a generally rectangular configuration. The chamber 104 is of a circular configuration. Fluid inlet 110 is illustrated as extending over the top 116 of the chamber 104. The outlet 122 is shown as opening to the interior volume 114 of the chamber 104. Conduit 126 extends away from the chamber 124 and is generally directed toward the drain 106.

Figure 9:
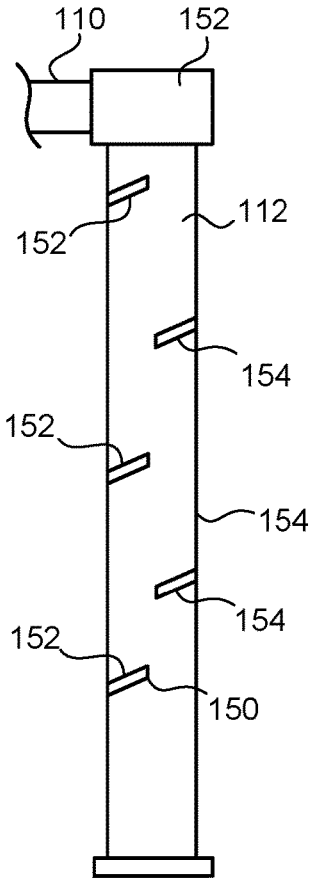
FIG. 9 is a side elevational view of the pipe as used in the alternative embodiment of the mop cleaning system of FIGS. 7 and 8.

FIG. 9 illustrates the configuration of the pipe 112. It can be seen that there are a plurality of apertures 150 formed through the wall thickness of the pipe 112. The water inlet 110 is connected to a top 152 of the pipe 112 so as to allow for the introduction of water into the interior of the pipe 112. Within the concept of the present invention, the connection between the water inlet 110 and the pipe 112 can be at any location along the length of the pipe 112.

In FIG. 9, it can be seen that each of the apertures 150 is in the nature of a slot. The apertures 150 are positioned generally spaced parallel relationship to each other along the length of the pipe 112. A first set of apertures 152 will extend in one direction along a portion of the pipe 112 generally adjacent to the wall 130 of the chamber 104. A second set of apertures 154 are positioned on the pipe 112 away from the first set of apertures 152. The second set of apertures 154 are directed further away from the wall 130 of the chamber 104 than the apertures 152. The apertures 154 are interposed longitudinally between adjacent pairs of the apertures 152. As such, this is configured to establish a broad fan-style spray of water flow from the pipe 112. It can be seen that each of the first set of apertures 152 and the second set of apertures 154 are canted at an approximately 30° angle to horizontal. The slotted type of aperture 150, as opposed to holes or other types of openings, is intended to create a fan of water as it is ejected under pressure from each of the apertures 150. However, within the concept of the present invention, the apertures 150 can include holes, openings, and similar techniques for releasing the water under pressure from the pipe 112. Additionally, spray-type fittings can be placed within the holes formed in the pipe 112. It is believed that the fan-shaped flow of water greatly facilitates the pressure washing of the mop strings. Additionally, such a fan-type spray further serves to distribute the pressurized water over a greater area than the release of water through the simple use of a simple circular hole pattern.

Figure 10:
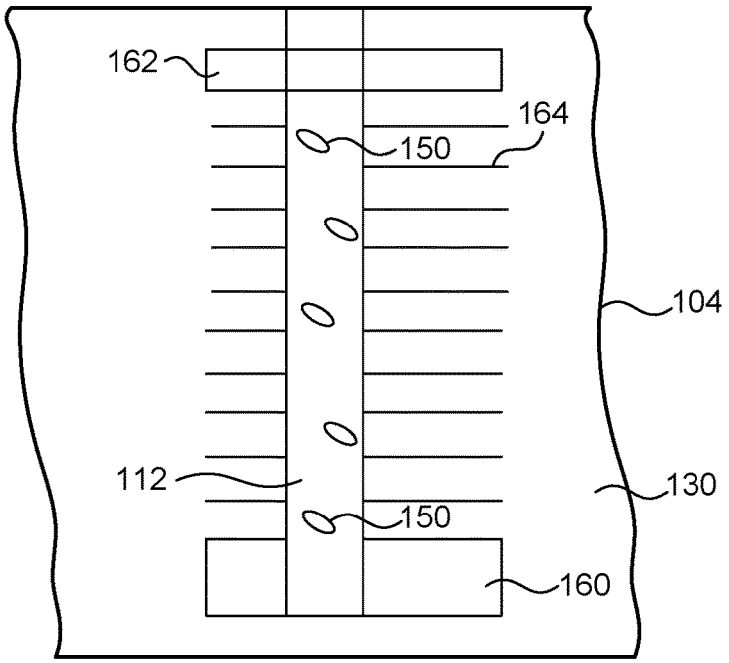
FIG. 10 is a frontal view of the pipe as used in the alternative embodiment of the mop cleaning system of FIGS. 7 and 8.

FIG. 10 particularly illustrates the configuration of the pipe 112 as positioned against the inner wall 130 of the chamber 104. It can be seen that the pipe 112 includes apertures 150 arranged in the manner described herein previously. There is a lower portion 160 positioned adjacent to the inner wall 130 and an upper portion 162 positioned against the inner wall 130. Portions 160 and 162 are at opposite ends of the pipe 112. A plurality of spacers 164 extend outwardly of the pipe 112 and, as will be described hereinafter, serve to bear against the inner wall 130 of the chamber 104. The spacers 164, which are in the nature of the fins, serve to convey the debris in a direction over and away from the pipe 112. As such, this avoids any possible lodging of debris between the inner wall 130 and the pipe 112. This avoids any impeding of the water flow from the apertures 150. The spacers or fins also serve to create a desirable laminar flow patterns of the cyclonic flow of water within the chamber 104.

Figure 11:
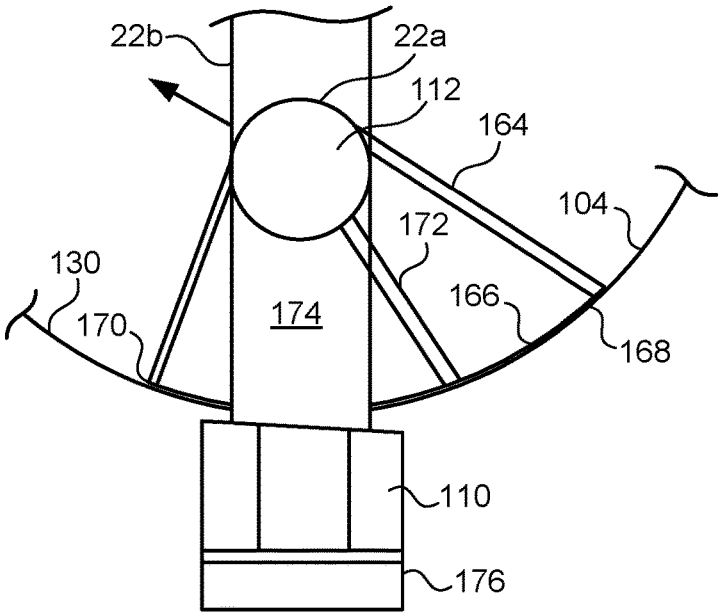
FIG. 11 is a plan view showing the pipe as used in the alternative embodiment of a mop cleaning system of FIGS. 7 and 8.

FIG. 11 illustrates the end view of the pipe 112. Pipe 112 is illustrated as positioned adjacent to the inner wall 130 of the chamber 104. Spacers 164 have a fan-shaped configuration so as to extend to an outer edge 166. One end 168 of the outer edge 166 is spaced further from the pipe 112 than the opposite end 170 of the spacers 164. A rib 172 extends across the spacers 164 to enhance the structural stability of the spacers. A conduit 174 extends from the pipe 112. Conduit 174 communicates with the interior of the pipe 112. Conduit 174 is part of the fluid inlet 110 (as shown in FIGS. 7 and 8). The conduit 174 has a connector 176 thereon which can serve to receive a water hose from the water source. As such, this allows water to be introduced into the interior of the pipe 112.

Figure 12:
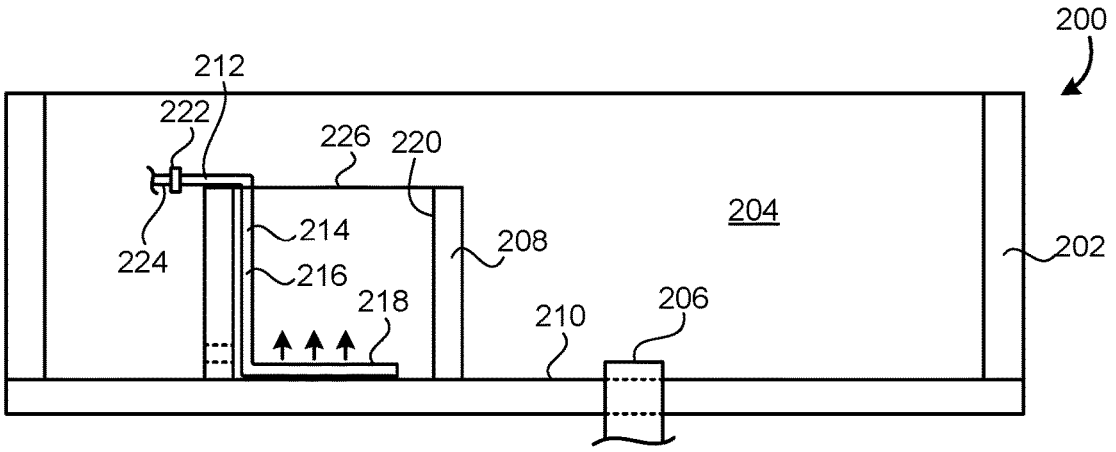
FIG. 12 is a side cross-sectional view of a second alternative embodiment of the mop cleaning system of the present invention.

FIG. 12 shows another alternative embodiment of the mop cleaning system 200 of the present invention. Mop clean system 200 includes a mop basin 202 having an interior volume 204 and a drain 206. The chamber 208 is positioned at the floor 210 of the mop basin 202 away from the drain 206. Water inlet 212 has a pipe 214 having a first portion 216 and a second portion 218. The second portion 218 is located generally adjacent to the bottom 210 of the chamber 212. The first portion 216 extends vertically within the chamber 218. As shown in FIG. 12, the first portion 216 of the pipe 212 is positioned adjacent to an inner wall 220 of the chamber 208. Water inlet 220 has a connector 222 which allows the water inlet 212 to be connected to the hose 200.

In FIG. 12, it can be seen that the second portion 218 of the pipe 214 is configured to release water in an upward direction (as illustrated by the arrows). The apertures associated with the second portion 218 can be configured to also create a flow path of water within the chamber 208. In use, water will flow through the water inlet 212, through the first portion 216 of pipe 214, and into the second portion 218 and be released therefrom. It is within the concept of the present invention that the apertures (as shown in the previous embodiment of the present invention) can also be applied to the first portion 216 the pipe 218. As such, the mop cleaning system 200, shown in FIG. 12, will create a sweeping water flow and also create an upward flow of water so as to further urge the dirt, debris and grease upwardly and outwardly of the chamber 218.

The chamber 208 in this embodiment does not include an outlet formed through a wall of the chamber 208. In this embodiment, the outlet will simply be the open top 226 of the chamber 208. As such, this embodiment intentionally overflows the top of the chamber 208 so that dirt, debris and grease are released from the open top of the chamber 208 and will flow within the interior volume 204 of the mop basin 212 toward the drain 206.

Figure 13:
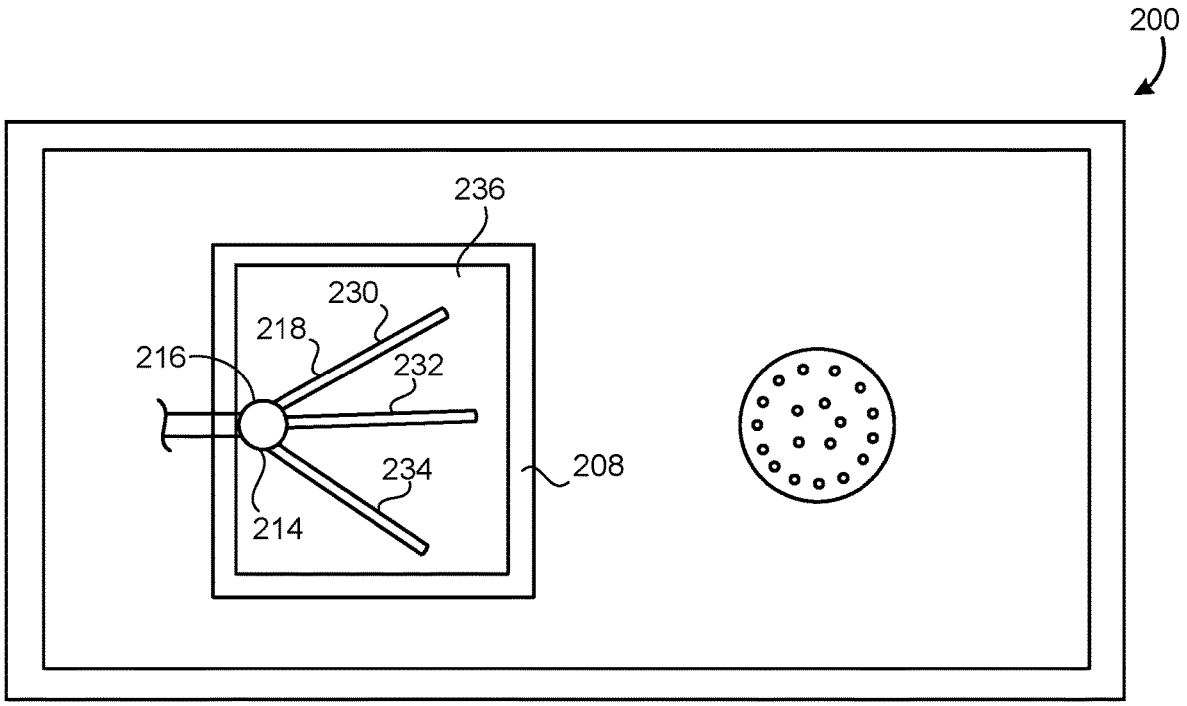
FIG. 13 is a plan view showing the second alternative embodiment of the mop cleaning system of FIG. 12

FIG. 13 is a plan view of the mop cleaning system 200 (as shown in FIG. 12). In particular, in FIG. 13, it can be seen that the second portion 218 of the pipe 214 includes a plurality of pipe sections 230, 232 and 234. These pipe sections 230, 232 and 234 radiate outwardly from the first portion 216 of the pipe 214. The pipes sections 230, 232 and 234 are radially spaced from each other. These multiple pipe sections 230, 232 and 234 distribute the upward flow of water over a greater area of the interior volume 236 of the chamber 208. As such, this upward flow of water is distributed over a greater area of the mop strings that are introduced into the interior volume 236 of the chamber 208.

The present invention, in its various embodiments, is great improvement over conventional mop basins. The use of the chamber within the mop basin and the use of water delivered to the interior of the chamber greatly enhances the ability for workers to clean mops. Since the water inlet to the chamber is connected to a source of pressurized water, such as a faucet, it is only necessary to activate the faucet in order to deliver water into the chamber. In particular, the hot water valve of the faucet can be activated so as to deliver hot cleaning water into the interior volume of the chamber. This can be done quite simply by simply turning the knob. As the chamber begins to fill with water, the worker can simply introduce the strings and the mop into the interior of the chamber. The sweeping and turbulent flow of water within the chamber effectively removes dirt, debris and grease from the mop strings. This dirt, debris and grease will flow automatically through the outlet of the chamber and into the drain of the mop basin. As such, no extra work is required for the cleaning of the mop strings. The continuous flow of water into the chamber continually cleans the mop strings with clean water. As such, the present invention avoids the problems of previous mop basins where dirty water is used to clean mop strings. As a result, the mop strings will continue to be very clean. After cleaning, the workers simply removes the mop strings from the chamber and places the mop on a hook so that the mop strings can drain into the mop basin. The chamber can be integrally built with the mop basin (such as mop basin shown in the configuration of the prior art in FIG. 2) or can be retroactively applied to the existing mop basin (by a fixing the chamber to the mop basin in a location away from the drain).

The foregoing disclosure and description of the invention is illustrative and explanatory thereof. Various changes in the details of the illustrated construction, or in the steps of the described method, can be made within the scope of the present claims without departing from the true spirit of the invention. The present invention should only be limited by the following claims and their legal equivalents.

I claim:

1. A mop cleaning system comprising:

a mop basin having a floor and a drain;

a chamber affixed to said mop basin in a location away from the drain, said chamber having an open top and an interior volume;

a water inlet opening within the interior volume of said chamber, said water inlet adapted to pass water in an area adjacent to a bottom of said chamber; and a water source connected to said water inlet and adapted to pass water under pressure and to said water inlet.

2. The mop cleaning system of claim 1, said chamber being fixedly mounted to the floor of said mop basin.

3. The mop cleaning system of claim 1, said chamber having a rectangular configuration, a square configuration or a circular configuration.

4. The mop cleaning system of claim 1, said water inlet extending through a wall of said chamber so as to have one end within the interior volume of said chamber, said water inlet having a connector at an opposite end thereof, the connector being connected to said water source.

5. The mop cleaning system of claim 4, the one end of said water inlet being a nozzle, said nozzle adapted to direct water in a flow path within said chamber adjacent to the floor of said chamber.

6. The mop cleaning system of claim 5, said nozzle having an aperture having a shape of a chord of a circle, the chord being below a curved portion of the circle.

7. The mop cleaning system of claim 1, said water inlet comprising:

a pipe extending vertically within said chamber, said pipe having a plurality of apertures formed through a wall thereof, said plurality of apertures adapted to direct water in a cyclonic path within said chamber.

8. The mop clean system of claim 7, said plurality of apertures comprising a first set of apertures extending in one direction and a second set of apertures extending in another direction, one of the first and second sets of apertures being directed further away from a wall of said chamber than the other of the first and second sets of apertures.

9. The mop cleaning system of claim 7, further comprising:

a plurality of spacers affixed said pipe and extending outwardly therefrom, said plurality of spacers bearing against a wall of said chamber, said plurality of spacers being in spaced relation to each other.

10. The mop cleaning system of claim 7, said pipe having a first portion and a second portion, the first portion extending vertically within said chamber, the second portion radiating outwardly from the first portion, at least one of the first and second portions having the plurality of apertures.

11. The mop cleaning system of claim 10, the second portion of said pipe being positioned adjacent to the bottom of said chamber, the second portion of said pipe extending from a bottom of the first portion of said pipe.

12. The mop cleaning system of claim 11, the second portion of said pipe having the plurality of apertures, the plurality of apertures of the second portion of said pipe opening so as to direct water upwardly in said chamber.

13. The mop cleaning system of claim 10, the second portion of said pipe comprising a plurality of pipe sections radiating outwardly from a bottom of the first portion of said pipe, said plurality of pipe sections being radially spaced from each other.

14. The mop cleaning system of claim 1, said chamber having an outlet, the outlet being the open top of said chamber.

15. The mop cleaning system of claim 1, said chamber having an outlet, the outlet being an opening through a wall of said chamber, the outlet being positioned above said water inlet.

16. The mop cleaning system of claim 1, said chamber having an outlet, the outlet being a conduit extending from said chamber and directed toward said drain such that water from said chamber is directed toward said drain.

17. The mop cleaning system of claim 1, said water source being a faucet positioned above said mop basin, said faucet having a hose extending so as to connect to said water inlet.

* * * * *